US006661902B1

(12) United States Patent
Ziegler et al.

(10) Patent No.: US 6,661,902 B1
(45) Date of Patent: Dec. 9, 2003

(54) LOUDSPEAKER WITH A FRONT-MOUNTED SEALING ELEMENT AND METHOD OF MANUFACTURING THE SAME

(75) Inventors: Gerhard Ziegler, Wunfirdel (DE); Gerhard Laugmann, Naila (DE); Hans-Jürgen Gach, Artantoren (DE); Werner Brauner, Dingolfing (DE)

(73) Assignee: Harman Audio Electronic Systems GmbH, Straubing (DE)

( * ) Notice: Subject to any disclaimer, the term of this patent is extended or adjusted under 35 U.S.C. 154(b) by 215 days.

(21) Appl. No.: 09/588,906

(22) Filed: Jun. 7, 2000

(30) Foreign Application Priority Data

Jun. 8, 1999 (DE) ..... 199 25 944

(51) Int. Cl.[7] ..... H04R 1/02
(52) U.S. Cl. ..... 381/386; 181/150
(58) Field of Search ..... 381/386, 389, 381/392, 395, 300, 302, 303, 304, 305, 307; 181/141, 150, 171, 172

(56) References Cited

U.S. PATENT DOCUMENTS

| | | | | |
|---|---|---|---|---|
| 3,612,783 A | * | 10/1971 | Schneider | 381/404 |
| 4,191,865 A | | 3/1980 | King et al. | 179/178 |
| 4,550,429 A | * | 10/1985 | Burbank et al. | 379/420.02 |
| 4,565,905 A | | 1/1986 | Nation | 179/115.5 |
| 4,653,607 A | * | 3/1987 | Bage | 181/171 |
| 5,705,108 A | | 1/1998 | Nonogaki | 264/46.4 |
| 5,739,481 A | * | 4/1998 | Baumhauer et al. | 181/148 |
| 5,740,264 A | | 4/1998 | Kojima | 381/193 |
| 6,058,199 A | * | 5/2000 | Umitsu | 181/151 |
| 6,457,547 B2 | * | 10/2002 | Novitschitsch | 181/150 |

FOREIGN PATENT DOCUMENTS

| | | | |
|---|---|---|---|
| DE | 195 01 292 A1 | 7/1996 | |
| DE | 196 33 097 | 3/1997 | H04R/7/02 |
| DE | 196 26 813 | 4/1997 | H04R/7/20 |
| DE | 197 40 400 A1 | 9/1997 | |
| DE | 197 13 897 A1 | 11/1997 | |
| EP | 0 783 238 A2 | 7/1997 | 7/18 |
| JP | 10136486 | 5/1998 | 7/22 |

OTHER PUBLICATIONS

European Search Report, EP Ser.. No. 00 11 1613, search concluded Jan. 29, 2003.

* cited by examiner

*Primary Examiner*—Curtis Kuntz
*Assistant Examiner*—Brian Ensey
(74) *Attorney, Agent, or Firm*—Brinks Hofer Gilson & Lione

(57) ABSTRACT

A loudspeaker and a method of manufacturing a loudspeaker having a front-mounted sealing element is disclosed. A molded sealing element made of thermoplastic elastomer is disposed on the front end face of the loudspeaker. The loudspeaker according to the invention, unlike conventional loudspeakers having foam sealing strips, is easier to manufacture and produces a better acoustic seal, as well as improved temperature and humidity stability.

12 Claims, 6 Drawing Sheets

LOUDSPEAKER WITH A FRONT-MOUNTED SEALING ELEMENT AND METHOD OF MANUFACTURING THE SAME

FIELD OF THE INVENTION

The invention relates to a loudspeaker with a front-mounted sealing element which abuts a wall and acoustically seals against the wall when the loudspeaker is installed, and to a method of manufacturing a loudspeaker of this type.

BACKGROUND OF THE INVENTION

Figure 1:
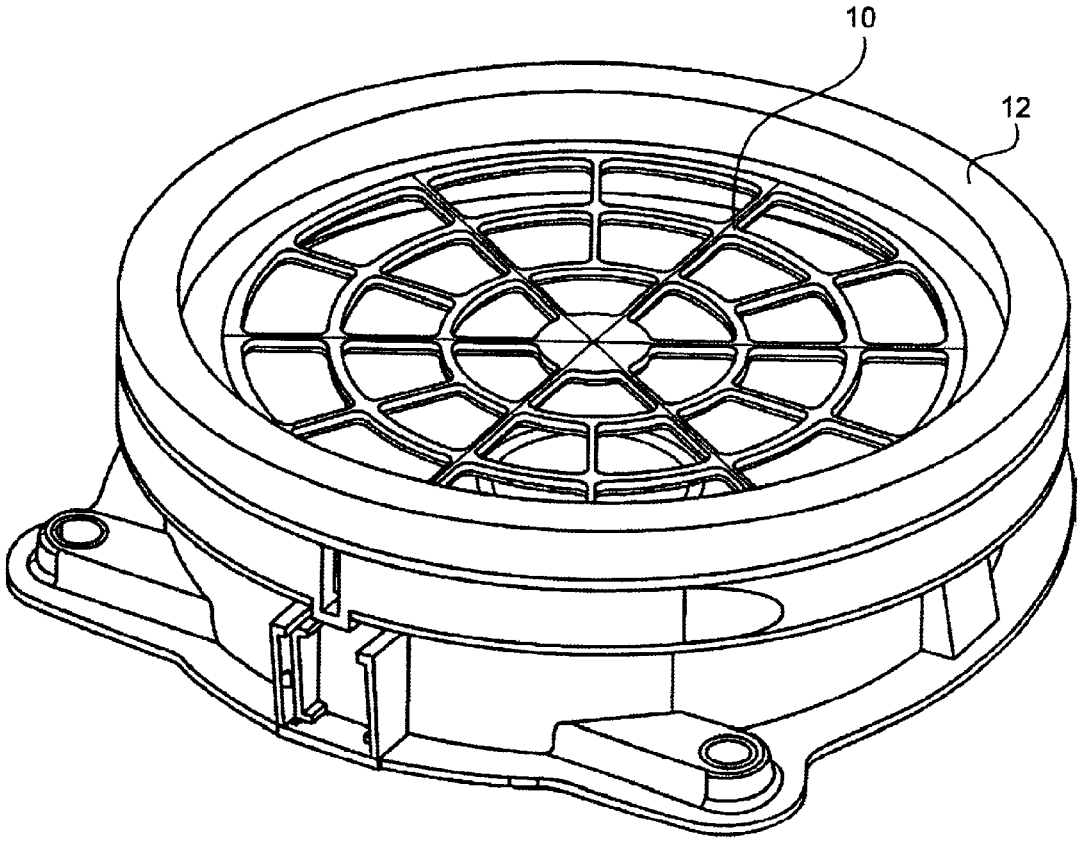
FIG. 1 PRIOR ART
Figure 2:
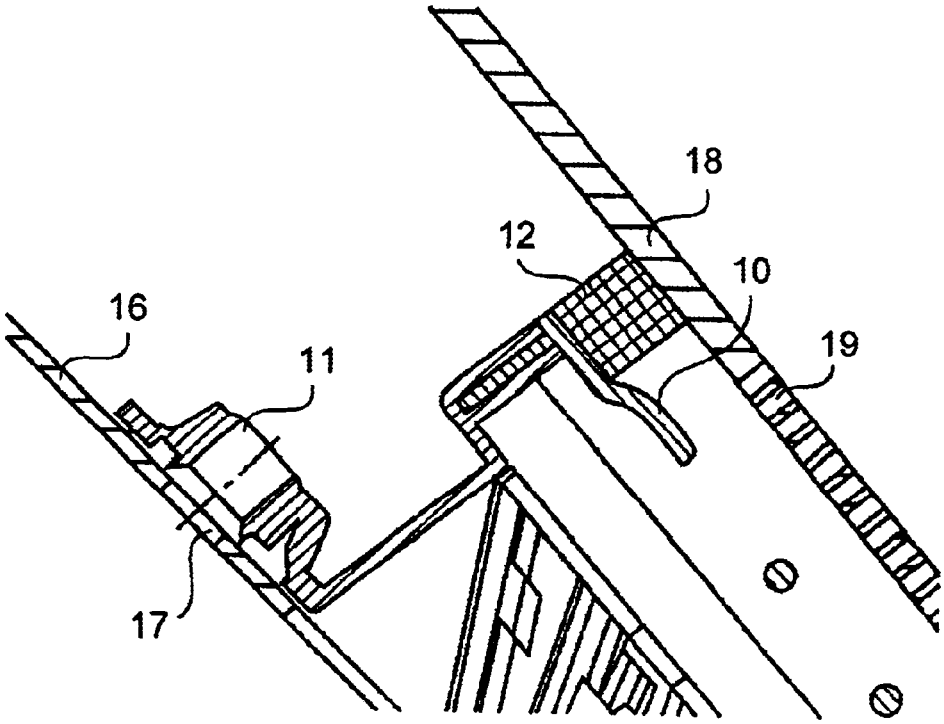
FIG. 2 PRIOR ART

As shown schematically in FIGS. 1 and 2, loudspeakers are typically sealed against the interior door panels of automobiles with open-cell foam sealing strips which may or may not be impregnated and have cross-sectional dimensions of 2×4 mm to 20×25 mm. The foam sealing strip 12 can be attached to the loudspeaker frame, to a loudspeaker frame adapter, a loudspeaker support or a loudspeaker grille using an adhesive. The foam sealing strip 12 shown in FIG. 1 has an annular shape with a square cross-section and is affixed to the annular outer region of the loudspeaker cover grille 10 with an adhesive. The end face of the foam sealing strip 12 facing away from the loudspeaker cover grille 10 makes contact with the interior door panel 18 over a surface area to provide an acoustic seal. In addition, the door panel 18 has openings 19 which allow the acoustic waves produced by the loudspeaker to enter the vehicle compartment. The loudspeaker itself can be attached to the interior wall 16 of the door using bores 11,17 provided in the loudspeaker and in the inner wall 16 of the door, respectively.

Foam sealing strips disadvantageously do not produce an absolute seal due to their open cell construction. Moreover, adhesion of the foam sealing strips is. strongly dependent on the environmental conditions. Car buyers have been known to complain about non-adhering, poorly adhering or completely detached foam strips, when such seals are employed between the loudspeakers and the interior door panel. It has also been observed that such problems occur more frequently when the automobile and hence also the loudspeakers with the attached foam sealing strips are subjected to large changes in ambient temperature and/or to high humidity.

The problem becomes more pronounced with loudspeakers having a relatively small diameter of, for example, between approximately 130 and 160 mm, because the foam sealing strips have a smaller radius as compared to larger loudspeakers, thereby producing even greater separation forces under changing ambient temperature and/or high humidity conditions.

Foam sealing strips attached with an adhesive may disadvantageously also preclude prefabrication and/or complete assembly of the loudspeaker at a factory. Conventional foam sealing strips may also impede and even prevent online manufacture of the loudspeaker on an automatic loudspeaker assembly is line at reasonable cost.

It is therefore an object of the present invention to provide a loudspeaker which can provide an optimal acoustic seal, is easy to manufacture, and has a good temperature and humidity resistance. It is another object to provide a method for its manufacture.

SUMMARY OF THE INVENTION

According to an aspect of the invention, the loudspeaker includes a sealing element made of a thermo-elastic polymer which is molded as a single piece to the front side of the loudspeaker.

The sealing element can be molded to a frame supporting the loudspeaker, to a loudspeaker adapter, or to a loudspeaker cover grille or to a similar component of the loudspeaker using a two-component technique. Advantageously, the sealing element is made of a thermoplastic elastomer (TPE), wherein the cross-section of the TPE sealing element is designed to have an elastic deformation range capable of bridging a gap located between the loudspeaker and a wall to which the loudspeaker is to be mounted. The cross-section, for example, can be Z-shaped or approximately Z-shaped. The TPE sealing element may also be made of a polypropylene material, such as poly (carbodiimide) polymer and/or DAPLEN™.

The TPE sealing element may be molded directly to the loudspeaker frame, the loudspeaker frame adapter or the loudspeaker cover grille. Advantageously, the TPE sealing element has a substantially annular shape, when viewed from the top of the loudspeaker, i.e., normal to the front side of the loudspeaker.

The loudspeaker frame may be made of plastic, and the TPE sealing element can be molded to a front end wall of the loudspeaker frame or the loudspeaker frame adapter. In addition, the front end wall of the loudspeaker frame or of the loudspeaker frame adapter may include an annular groove, with a wall section of the TPE sealing element molded into the groove. The TPE sealing element may also include a projecting sealing lip facing the wall against which the loudspeaker is to be sealed. A loudspeaker of this type is particularly suited for installation in an automobile door, wherein the loudspeaker can be attached to an interior wall portion of the door, with the TPE sealing element sealing against the interior door panel.

The loudspeaker according to the invention has a the following advantages:

- providing a hermetic seal, since the material of the sealing element is impermeable to air,
- eliminating adhesion problems between the sealing element and the loudspeaker, because the sealing element is molded to the loudspeaker and is therefore connected to the loudspeaker to form a single piece,
- enabling online manufacturing.

The invention will be described hereinafter with reference to certain embodiments illustrated the drawings. The invention, however, is not limited to the illustrated embodiments.

BRIEF DESCRIPTION OF THE INVENTION

Figure 3:
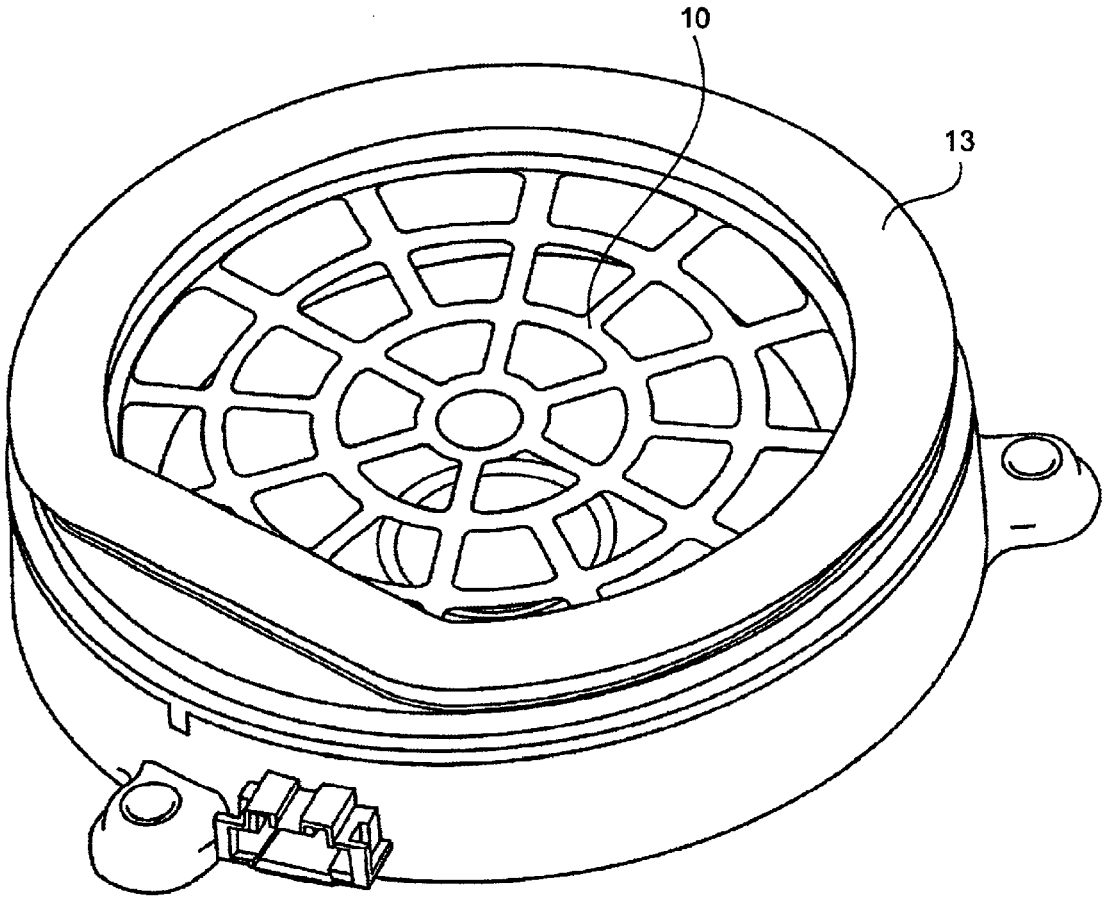
Figure 4:
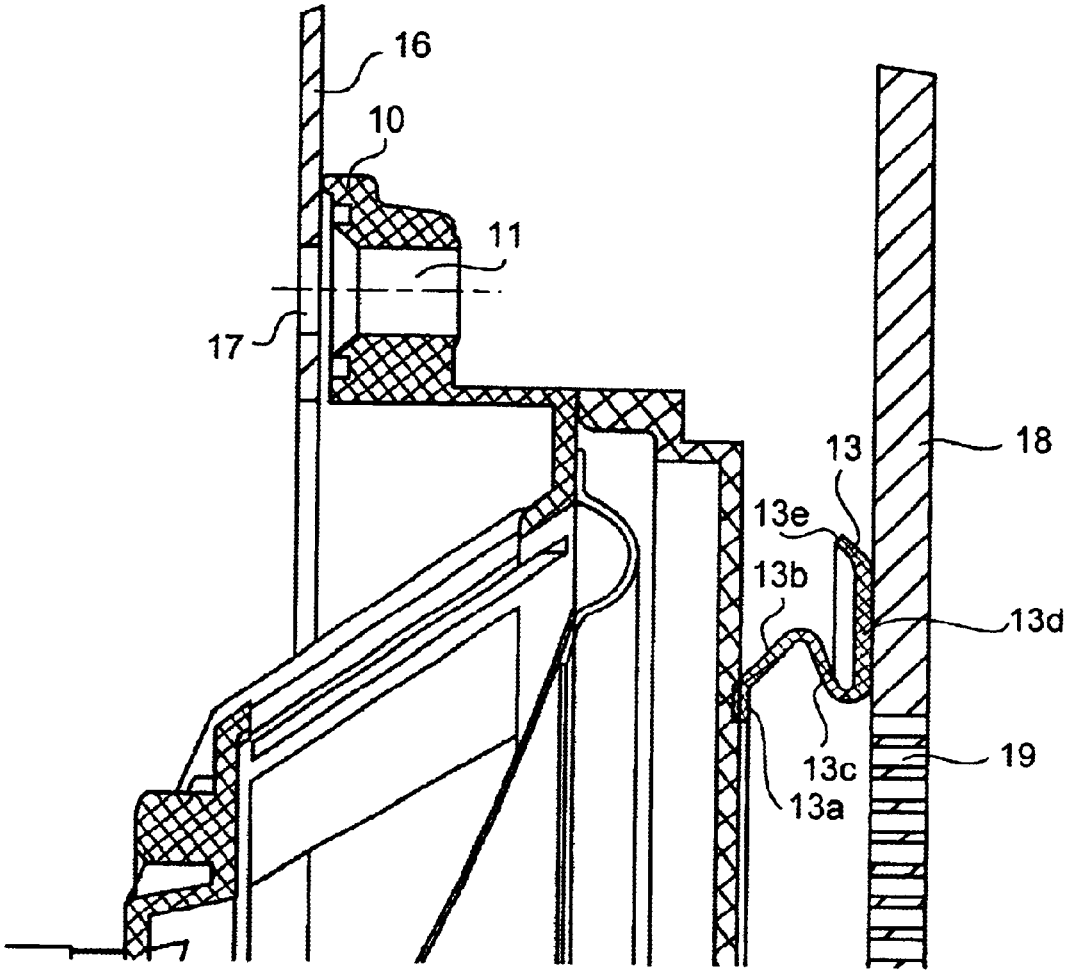
Figure 5:
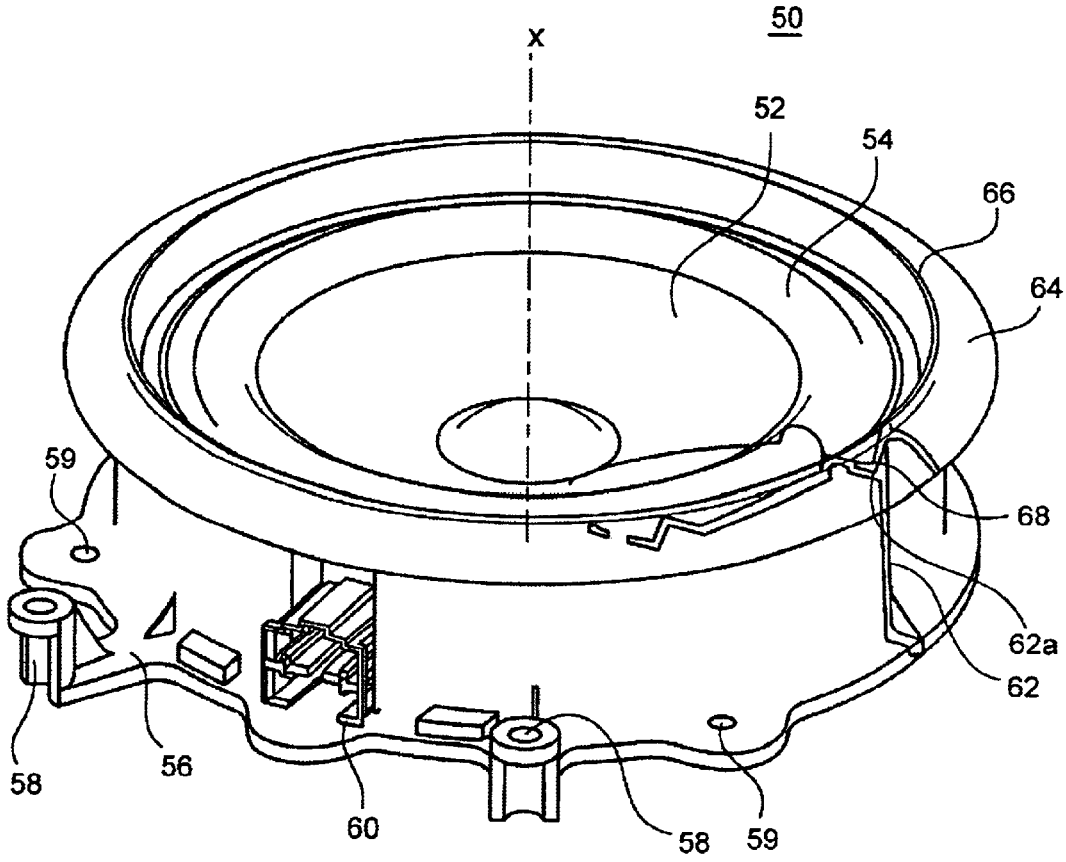
Figure 6:
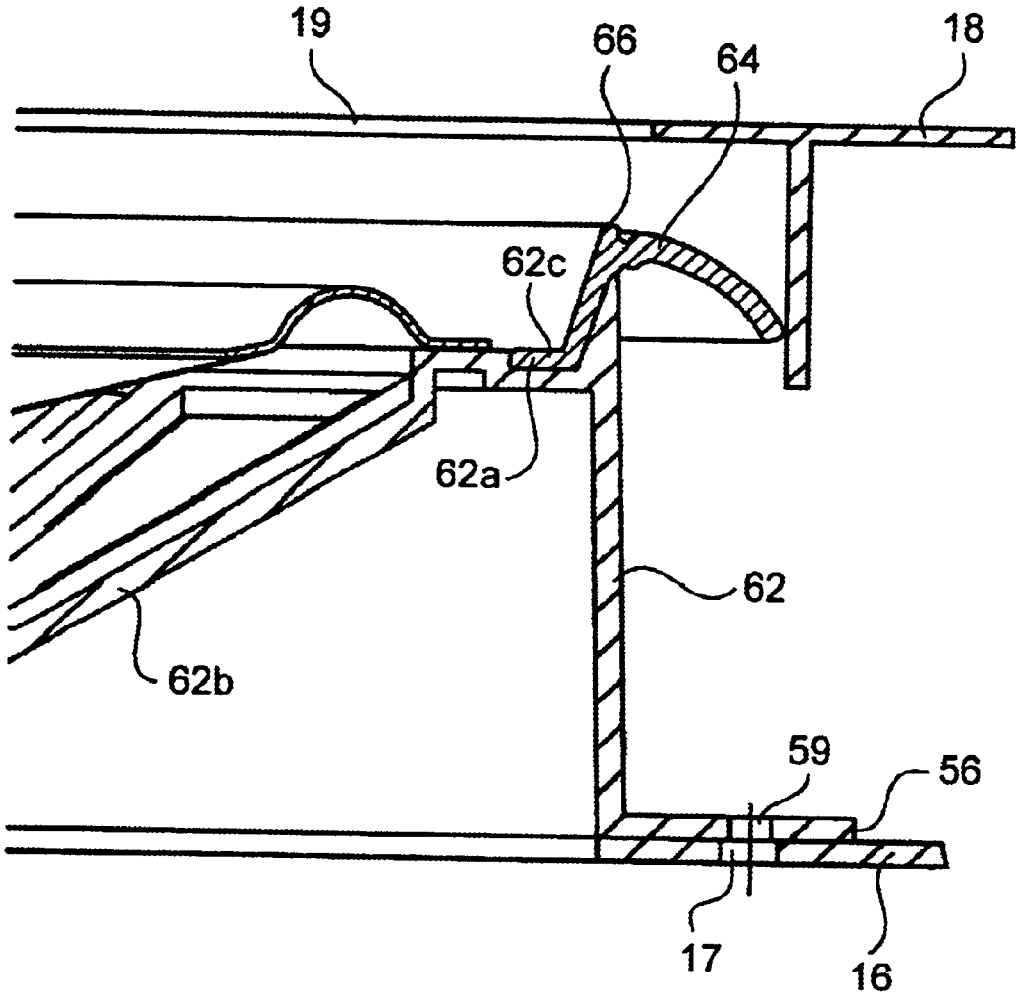

FIG. 1 is a perspective view of a conventional loudspeaker with a sealing strip affixed with an adhesive, FIG. 2 is a partial sectional view through a conventional loudspeaker installed between an interior door wall and a door panel and having a sealing strip affixed with an adhesive, FIG. 3 is a perspective view of a loudspeaker with a TPE sealing strip molded to the loudspeaker FIG. 4 is a partial sectional view, similar to FIG. 2, with a loudspeaker in this case having a molded TPE sealing strip inserted between the interior door wall and the doorpanel, FIG. 5 is a perspective view of a second embodiment of a loudspeaker according to the invention, and FIG. 6 is a partial cross-section of the second embodiment, similar to FIG. 2, with a loudspeaker having a molded TPE sealing ring inserted between the inner door wall (cylindrical stub on the loudspeaker diaphragm) and the door panel.

DETAILED DESCRIPTION OF CERTAIN ILLUSTRATED EMBODIMENTS

FIG. 3 is a perspective view the cover grille 10 of a loudspeaker. A sealing element 13 made of a thermoplastic elastomer (TPE) is secured to the annular outer rim of the cover grille 10 by a molding process. FIG. 4 shows a corresponding partial cross-sectional view. The cross-sectional view of FIG. 4 shows the loudspeaker installed between the interior door wall, i.e., the inside of the sheet metal 16 of the door, and the door panel 18. FIG. 4 uses the same reference numerals as FIG. 2 to indicate identical elements or elements performing an identical function.

The TPE sealing element 13 is molded onto the loudspeaker and/or the loudspeaker cover grille 10. As seen more clearly in FIG. 4, the sealing element 13 may include a plurality of wall sections, for example, five exemplary wall sections 13*a*, 13*b*, 13*c*, 13*d*, 13*e*, which are oriented in different directions with respect to the loudspeaker axis X (see FIG. 5). The loudspeaker cover grille 10 can be made of any type of plastic, whereas the sealing element 13 according to the invention is made of a thermoplastic elastomer. The thermoplastic elastomer can be, for example, a propylene material and, more particularly, a poly-carbo-di-imide polymer. A particularly suited material is DAPLEN™, and in particular the type DS65T20. Another material suitable for the sealing element 13 is SEBS (=TPE on a polystyrene basis). A material with a SEBS molecular structure has molecules consisting of thermoplastic polystyrene end sections (S) and an elastic ethylene-butyl center section (EB). Polystyrene domains are formed when the processed material cools down. A suitable SEBS material is commercially available under the trade name PTS-thermoflex.

The cross-section of the TPE sealing element 13 is advantageously selected so that the distance to the wall to be sealed, i.e., the distance to the inside of the door panel 18, is still within the elastic deformation range of the sealing element 13. In the embodiment shown in FIG. 4, the cross-section of the TPE sealing element 13 is approximately Z-shaped. The distal end of the TPE sealing element 13 facing away from the loudspeaker cover grille 10 sealingly abuts the inside of the door panel 18.

The TPE sealing element 13 does not necessarily have to be molded to the cover grille 10 of the loudspeaker. Alternatively, the TPE sealing element can also be molded to the loudspeaker frame, to a loudspeaker adapter, to a loudspeaker support or to another similar component of the loudspeaker.

FIG. 5 shows another embodiment of a loudspeaker according to the invention. The perspective view shows a loudspeaker 50 mounted on a loudspeaker base plate 56 and having a loudspeaker diaphragm 52, a loudspeaker flange 54 and a loudspeaker frame adapter 62. The separately listed components, i.e., the loudspeaker base plate 56, a connector 60 and the loudspeaker frame adapter 62 can be formed as a unitary one-piece component. The loudspeaker base plate 56 includes bores and/or openings 58 and 59 suitable for attaching the base plate 56 to the interior door wall, i.e., the inside of the door sheet metal of an automobile. The connector 60 is electrically connected to the loudspeaker and mounted on the loudspeaker base plate 56. The connector 60 can be coupled to an output of an audio device.

A TPE sealing element 64 is disposed on the cylindrical loudspeaker frame adapter 62. The front end wall of the loudspeaker frame adapter 62 includes an annular groove 62*a*, with a wall portion of the TPE sealing element 64 molded into the groove 62*a*.

Referring now also to FIG. 6, an additional wall section of the sealing element extends outwardly at an angle from the wall section 62*c* of the TPE sealing element 64, which is oriented perpendicular to the loudspeaker axis X (see FIG. 5), as viewed from the loudspeaker axis X towards the outside, and terminates in a sealing lip 66. A third wall section of the TPE sealing element 64 in the form of a circular segment extends from this sealing lip 66 in a direction away from the loudspeaker axis X. The third wall section of the TPE sealing element 64 provides a seal against the interior door panel, in this case through a cylinder which is directly molded to the door panel.

We claim:

1. A loudspeaker adapted for mounting against a wall, comprising a front-mounted sealing element, wherein the sealing element is made of a thermoplastic elastomer (TPE) and injection molded as a single piece on a front side of the loudspeaker, thereby providing an acoustic seal between the front side of the loudspeaker and the wall in an installed position of the loudspeaker.

2. The loudspeaker according to claim 1, wherein the TPE sealing element is made of a polypropylene material.

3. The loudspeaker according to claim 2, wherein the polypropylene material is a poly (carbodiimide) polymer.

4. The loudspeaker according to claim 1, wherein the loudspeaker further includes at least one of a loudspeaker frame, a loudspeaker frame adapter and a loudspeaker cover grille, and the TPE sealing element is molded directly to the at least one of the loudspeaker frame, loudspeaker frame adapter or loudspeaker cover grille.

5. The loudspeaker according to claim 1, wherein the TPE sealing element has a substantially annular shape, when viewed normal to the front side of the loudspeaker.

6. The loudspeaker according to claim 1, wherein the cross-section of the TPE sealing element is selected so that a distance to be bridged for sealing against the wall is in an elastic deformation range of the TPE sealing element.

7. The loudspeaker according to claim 6, wherein the TPE sealing element has a Z-shaped or at least approximately Z-shaped cross-section.

8. The loudspeaker according to claim 1, wherein the loudspeaker includes a loudspeaker frame made of plastic, a loudspeaker frame adapter and a loudspeaker base plate, with the TPE sealing element being molded to a front end wall of the loudspeaker frame or the loudspeaker frame adapter.

9. The loudspeaker according to claim 7, wherein the front end wall of the loudspeaker frame or of the loudspeaker frame adapter comprises an annular groove, with a wall section of the TPE sealing element molded into the groove.

10. The loudspeaker according to claim 1, wherein the TPE sealing element includes a projecting sealing lip facing the wall against which the loudspeaker is to be sealed.

11. The loudspeaker according to claim 1, wherein the loudspeaker is installed in a door of an automobile, the door having an interior door wall and an interior door panel, with the loudspeaker being attached to the interior door wall and the TPE sealing element sealingly abutting the interior door panel.

12. A loudspeaker adapted for mounting against a wall, comprising:

a sealing element disposed on a front face of the loudspeaker, wherein the sealing element is injection molded to the front face to form a single piece with the front face and comprises a plurality of wall sections which are oriented—when viewed in cross-section of the sealing element—in different directions with respect to a direction normal to the front face.

* * * * *

UNITED STATES PATENT AND TRADEMARK OFFICE

CERTIFICATE OF CORRECTION

PATENT NO. : 6,661,902 B1 
DATED : December 9, 2003
INVENTOR(S) : Gerhard Ziegler et al.

It is certified that error appears in the above-identified patent and that said Letters Patent is hereby corrected as shown below:

Title page,
Item [75], Inventors, delete "Wunfirdel" and substitute -- Wunsiedel -- in its place; delete "Laugmann," and substitute -- Laubmann, -- in its place; delete "Artantoren" and substitute -- Aiterhofen -- in its place.

Column 4,
Line 66, add claim 13 as follows:
-- 13. The loudspeaker according to claim 10, wherein the sealing lip has a circular segment shape. --

Signed and Sealed this

Twenty-third Day of November, 2004

JON W. DUDAS
*Director of the United States Patent and Trademark Office*